US008175869B2

(12) United States Patent
Sung et al.

(10) Patent No.: US 8,175,869 B2
(45) Date of Patent: May 8, 2012

(54) METHOD, APPARATUS, AND MEDIUM FOR CLASSIFYING SPEECH SIGNAL AND METHOD, APPARATUS, AND MEDIUM FOR ENCODING SPEECH SIGNAL USING THE SAME

(75) Inventors: Hosang Sung, Yongin-si (KR); Rakesh Taori, Suwon-si (KR); Kangeun Lee, Gangneung-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1451 days.

(21) Appl. No.: 11/480,449

(22) Filed: Jul. 5, 2006

(65) Prior Publication Data

US 2007/0038440 A1 Feb. 15, 2007

(30) Foreign Application Priority Data

Aug. 11, 2005 (KR) ..... 10-2005-0073825

(51) Int. Cl.
*G10L 19/00* (2006.01)

(52) U.S. Cl. ..... 704/218; 704/271; 704/239; 704/229; 704/219; 704/216; 704/208; 704/207; 704/205; 606/5; 356/73.1

(58) Field of Classification Search ..... 704/219, 704/271, 216, 239, 208, 207, 229, 205; 606/5; 356/73.1
See application file for complete search history.

(56) References Cited

U.S. PATENT DOCUMENTS

| | | | | |
|---|---|---|---|---|
| 4,908,863 | A * | 3/1990 | Taguchi et al. | 704/219 |
| 4,972,486 | A * | 11/1990 | Cornett et al. | 704/271 |
| 5,696,873 | A * | 12/1997 | Bartkowiak | 704/216 |
| 5,699,483 | A * | 12/1997 | Tanaka | 704/219 |
| 5,848,388 | A * | 12/1998 | Power et al. | 704/239 |
| 6,285,979 | B1 * | 9/2001 | Ginzburg et al. | 704/208 |
| 7,039,581 | B1 * | 5/2006 | Stachurski et al. | 704/205 |
| 2002/0038209 | A1 * | 3/2002 | Brandel et al. | 704/207 |
| 2002/0161576 | A1 * | 10/2002 | Benyassine et al. | 704/229 |
| 2002/0176071 | A1 * | 11/2002 | Fontaine | 356/73.1 |
| 2004/0181411 | A1 | 9/2004 | Gao | |
| 2005/0182620 | A1 * | 8/2005 | Kabi et al. | 704/216 |
| 2005/0267746 | A1 | 12/2005 | Jelinck et al. | |
| 2006/0247608 | A1 * | 11/2006 | Hahn et al. | 606/5 |

FOREIGN PATENT DOCUMENTS

| | | |
|---|---|---|
| JP | 10-222194 | 8/1998 |
| KR | 10-2005-0049537 | 5/2005 |

OTHER PUBLICATIONS

Korean Office Action dated Mar. 30, 2011, in corresponding Korean Patent Application No. 10-2005-0073825.

* cited by examiner

*Primary Examiner* — Richemond Dorvil
*Assistant Examiner* — Michael Colucci
(74) *Attorney, Agent, or Firm* — Staas & Halsey LLP

(57) ABSTRACT

A method, apparatus, and medium for classifying a speech signal and a method, apparatus, and medium for encoding the speech signal using the same are provided. The method for classifying a speech signal includes calculating classification parameters from an input signal having block units, calculating a plurality of classification criteria from the classification parameters, and classifying the level of the input signal using the plurality of classification criteria. The classification parameters include at least one of an energy parameter of the input signal, a cross-correlation parameter between a specific block of a present frame and the input signal, and an integrated cross-correlation parameter obtained by accumulating the cross-correlation parameter.

28 Claims, 4 Drawing Sheets

METHOD, APPARATUS, AND MEDIUM FOR CLASSIFYING SPEECH SIGNAL AND METHOD, APPARATUS, AND MEDIUM FOR ENCODING SPEECH SIGNAL USING THE SAME

CROSS-REFERENCE TO RELATED APPLICATIONS

This application claims the benefit of Korean Patent Application No. 10-2005-0073825, filed on Aug. 11, 2005, in the Korean Intellectual Property Office, the disclosure of which is incorporated herein in its entirety by reference.

BACKGROUND OF THE INVENTION

1. Field of the Invention

The present invention relates to a process of encoding a speech signal, and more particularly, to a method, apparatus, and medium for rapidly and reliably classifying an input speech signal when encoding the speech signal and a method, apparatus, and medium for encoding the speech signal using the same.

2. Description of the Related Art

A speech encoder converts a speech signal into a digital bit stream, which is transmitted over a communication channel or stored in a storage medium. The speech signal is sampled and quantized with 16 bits per sample and the speech encoder represents the digital samples with a smaller number of bits while maintaining good subjective speech quality. A speech decoder or synthesizer processes the transmitted or stored bit stream and converts it back to a sound signal.

In a wireless system using code division multiple access (CDMA) technology, the use of a source-controlled variable bit rate (VBR) speech encoder improves system capacity. In the source-controlled VBR encoder, a codec operates at several bit rates, and a rate selection module is used to set the bit rate used for encoding each speech frame based on the nature of the speech frame (e.g. voiced, unvoiced, transient, background noise). Furthermore, the aim of encoding with the source-controlled VBR encoder is to obtain optimum sound quality at a given average bit rate, that is, an average data rate (ADR). The codec may operate in different modes by adjusting the rate selection module such that different ADRs are obtained in different modes with improved codec performance. The operation mode is determined by the system according to a channel state. This allows the codec to make a trade-off between the speech quality and the system capacity.

As can be seen from the above description, the signal classification is very important for an efficient VBR encoder.

In a standard speech encoder using the CDMA technology, a voice activity detector (VAD) or a selected mode vocoder (SMV) is used as a speech classifying apparatus. The VAD detects only whether an input signal is speech or non-speech. The SMV determines a transmission rate in every frame in order to reduce bandwidth. The SMV has transmission rates of 8.55 kbps, 4.0 kbps, 2.0 kbps, and 0.8 kbps, and sets one of the transmission rates for a frame unit to encode a speech signal. In order to select one of the four transmission rates, the SMV classifies an input signal into six classes, that is, silence, noise, unvoiced, transient, non-stationary voiced, and stationary voiced.

However, a conventional SMV uses parameters of the codec on the input speech signal, such as calculation of a linear prediction coefficient (LPC), recognition weight filtering and detection of an open-loop pitch, in order to classify the speech signal. Accordingly, the speech classifying device depends on the codec.

Moreover, since the conventional speech classifying apparatus classifies the speech signal in a frequency domain using a spectral component, the process is complicated and it takes much time to classify the speech signal.

SUMMARY OF THE INVENTION

Additional aspects, features and/or advantages of the invention will be set forth in part in the description which follows and, in part, will be apparent from the description, or may be learned by practice of the invention.

The present invention provides a method, apparatus, and medium for rapidly and reliably classifying a speech signal using classification parameters calculated from an input signal having block units when encoding the speech signal and a method, apparatus, and medium for encoding the speech signal using the same.

According to an aspect of the present invention, there is provided a method of classifying a speech signal including: calculating from an input signal having block units classification parameters including at least one of an energy parameter of the input signal, a cross-correlation parameter between a specific block of a present frame and the input signal, and an integrated cross-correlation parameter obtained by accumulating the cross-correlation parameter; calculating a plurality of classification criteria from the classification parameters; and classifying the level of the input signal using the plurality of classification criteria.

The specific block may be a block having highest energy in the present frame. Alternatively, the specific block may be a block having energy closest to mean energy in the present frame. Alternatively, the specific block may be a block having energy closest to median energy between highest energy and lowest energy in the present frame. Alternatively, the specific block may be a block located at the center of the present frame.

The classification criteria may include at least one of an energy classification criterion calculated using the mean energy of each sub analysis frame obtained from the energy parameter, a cross-correlation classification criterion calculated using a zero cross frequency of the cross-correlation parameter, and an integrated cross-correlation classification criterion calculated using peaks of the integrated cross-correlation parameter greater than a predetermined threshold value.

According to another aspect of the present invention, there is provided an apparatus for classifying a speech signal including: a parameter calculating unit which calculates classification parameters from an input signal having block units, the classification parameters including at least one of an energy parameter of the input signal, a cross-correlation parameter between a specific block of a present frame and the input signal, and an integrated cross-correlation parameter obtained by accumulating the cross-correlation parameter; a classification criteria calculating unit which calculates a plurality of classification criteria from the classification parameters; and a signal level classifying unit which classifies the level of the input signal using the plurality of classification criteria.

According to another aspect of the present invention, there is provided a method for encoding a speech signal including: calculating classification parameters from an input signal having block units, calculating a plurality of classification criteria from the classification parameters, and classifying the input signal using the plurality of classification criteria, the classification parameters including at least one of an energy parameter of the input signal, a cross-correlation parameter between a specific block of a present frame and the input signal, and an integrated cross-correlation parameter obtained by accumulating the cross-correlation parameter; adjusting a bit rate of the present frame according to the result of classifying the input signal; and encoding the input signal according to the adjusted bit rate and outputting a bit stream.

According to another aspect of the present invention, there is provided an apparatus for encoding a speech signal including: a signal classifying unit which calculates classification parameters from an input signal having block units, calculates a plurality of classification criteria from the classification parameters, and classifies the input signal using the plurality of classification criteria, the classification parameters including at least one of an energy parameter of the input signal, a cross-correlation parameter between a specific block of a present frame and the input signal, and an integrated cross-correlation parameter obtained by accumulating the cross-correlation parameter; a bit rate adjusting unit which adjusts a bit rate of the present frame according to the result of classifying the input signal; and an encoding unit which encodes the input signal according to the adjusted bit rate and outputting a bit stream.

A method of classifying an input signal in time domain, including: calculating from the input signal having block units energy parameters of the input signal; calculating classification criteria from the energy parameters in the time domain; and encoding the input signal as a speech signal or a non-speech signal based on the calculated classification criteria.

At least one computer readable medium storing instructions that control at least one processor to perform a method including: calculating from the input signal having block units energy parameters of the input signal; calculating classification criteria from the energy parameters in the time domain; and encoding the input signal as a speech signal or a non-speech signal based on the calculated classification criteria.

BRIEF DESCRIPTION OF THE DRAWINGS

These and/or other aspects, features, and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
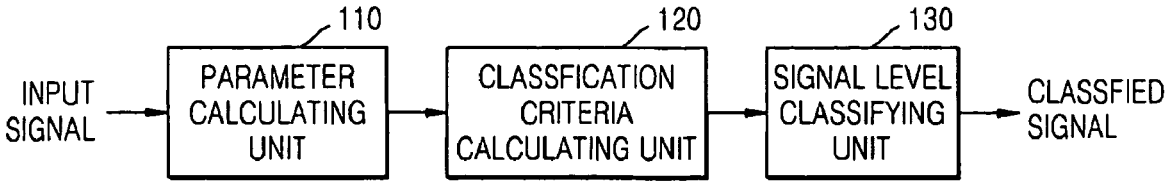
FIG. 1 is a block diagram of an apparatus for classifying a speech signal according to an exemplary embodiment of the present invention.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

FIG. 1 is a block diagram of an apparatus for classifying a speech signal according to an exemplary embodiment of the present invention. Referring to FIG. 1, the apparatus according to the present exemplary embodiment includes a parameter calculating unit 110, a classification criteria calculating unit 120, and a signal level classifying unit 130. The operation of the apparatus for classifying the speech signal will be described together with a flowchart illustrating a method of classifying a speech signal illustrated in FIG. 2.

Figure 2:
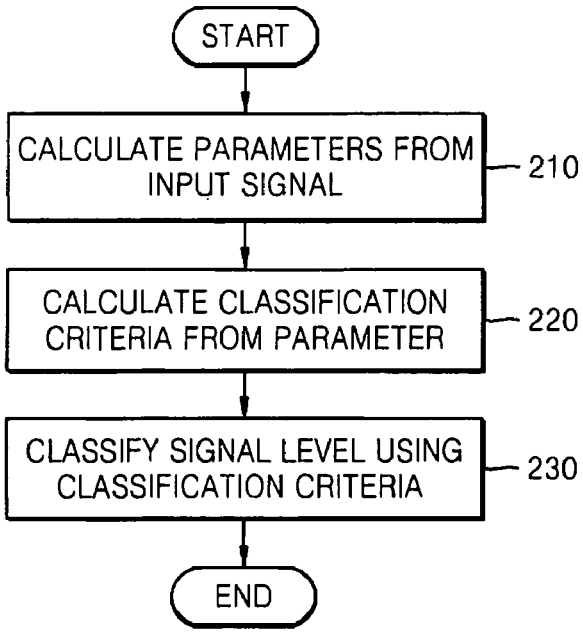
FIG. 2 is a flowchart illustrating a method of classifying a speech signal according to an exemplary embodiment of the present invention.

Referring to FIGS. 1 and 2, the parameter calculating unit 110 calculates a plurality of classification parameters from an input signal having block units (operation 210). The plurality of classification parameters can include an energy parameter E(k), a normalized cross-correlation parameter R(k), and an integrated cross-correlation parameter IR(k).

Figure 3:
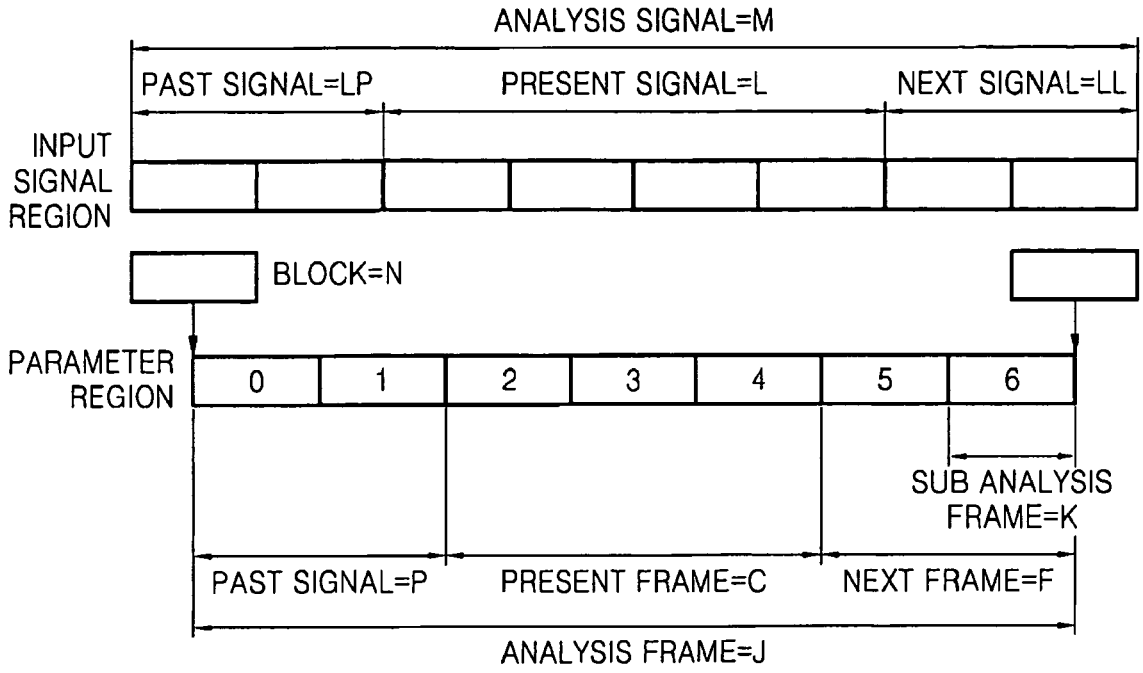
FIG. 3 illustrates a frame structure for converting an input signal region into a parameter region.

FIG. 3 illustrates a frame structure for converting an input signal region into a parameter region in order to obtain the classification parameters from the input signal in the block unit. As illustrated in FIG. 3, the input signal is an analysis signal composed of M samples, and includes a past signal composed of LP samples, a present signal composed of L samples, and a next sample composed of LL samples. The parameter calculating unit 110 converts the input signal region into the parameter region using an overlapping window function in order to calculate the plurality of parameters. In other words, one parameter may be obtained from a block composed of N samples, and a frame composed of the parameters is formed by processing each sample. An analysis frame of an analysis signal is composed of J (J=M−N) parameters, and includes a past frame composed of P parameters, a present frame composed of C parameters, and a next frame composed of F parameters. The past frame, the present frame, and the next frame each have an inherent sub analysis frame, which varies according to the sizes of the past signal, the present signal, and the next signal. The sub analysis frame is composed of K parameters.

The parameter calculating unit 110 obtains the energy parameter E(k) from the input signal having block units as follows:

$$E(k) = \sum_{m=0}^{N-1} y^2(m+k),\ k = 0, \ldots, M-N-1 \qquad \text{Equation 1}$$

Here, y(m+k) denotes a sample of the input signal in the block moved by k. When k=0, a first block in the analysis frame is represented and when k=M−N−1, a final block in the analysis frame is represented.

The parameter calculating unit 110 obtains the normalized cross-correlation parameter R(k) from a specific block of the present frame and the input signal as follows:

$$R(k) = \frac{\sum_{m=0}^{N-1} x(m)y(m+k)}{\sqrt{\sum_{m=0}^{N-1} x^2(m) \sum_{m=0}^{N-1} y^2(m+k)}},\ k = 0, \ldots, M-N-1 \qquad \text{Equation 2}$$

Here, x(m) denotes a signal sample of a specific block, and y(m+k) denotes a sample of the input signal in the block moved by k.

A method of obtaining a specific block may be one of the following four methods: a block having highest energy in the present frame may be selected as the specific block; a block having energy closest to mean energy in the present frame may be selected as the specific block; a block having energy closest to a median energy in the present frame may be selected as the specific block; a block located at the center of the present frame may be selected as the specific block.

Since the normalized cross-correlation parameter has a maximum value of 1, the change of the signal can be observed regardless of the size of the input signal.

Furthermore, the parameter calculating unit 110 obtains the integrated cross-correlation parameter IR(k) by summing the normalized cross-correlation parameter R(k) as follows:

$$IR(k) = \sum_{m=i}^{k} R(m),\ k = 1, \ldots, M - N - 1 \qquad \text{Equation 3}$$

IR(k) is obtained for each value of k by initially setting i=0 and IR(0)=R(0) and determining IR(k) for increasing values of k. i is set to k for each k satisfying (SlopeIR(k))*(SlopeIR(k−1))<0, that is, when the sign of the slope changes. In other words, IR(k) is obtained by summing R(k) from values of k where the sign of the slope changes. Here, SlopeIR(k)=IR(k)−IR(k−1).

The classification criteria calculating unit 120 calculates classification criteria using the classification parameters calculated by the parameter calculating unit 110 (operation 220).

The classification criteria calculating unit 120 obtains the mean energy $E_{mean_of_subframe}$ of each sub analysis frame relation to the energy parameter E(k). The classification criteria calculating unit 120 obtains at least one of the energy classification criteria from $E_{mean_of_subframe}$ using one of the following methods. The classification criteria calculating unit 120 can obtain a mean energy value $E_{mean_of_presentframe}$ of the present frame. Alternatively, the classification criteria calculating unit 120 may obtain a minimum energy value $E_{min}$ from the minimum of the mean energy of a first sub analysis frame and the mean energy of a final sub analysis frame. Alternatively, the classification criteria calculating unit 120 may obtain an energy change rate $R_{energy}$ by dividing a maximum energy value between a first sub analysis frame and a final sub analysis frame by a minimum energy value between the first sub analysis and the final sub analysis frame.

The energy classification criteria obtained from the energy parameter, that is, $E_{mean_of_presentframe}$, $E_{min}$, and $R_{energy}$, are used to distinguish speech and non-speech (for example, silence, background noise, etc.)

Furthermore, the classification criteria calculating unit 120 determines a zero cross frequency $N_{zero_cross}$ of the normalized cross-correlation parameter R(k). The zero cross frequency can be the number of times the sign of the normalized cross-correlation parameter changes. Speech has a small zero cross frequency, while noise, which is very random, has a greater zero cross frequency.

The classification criteria calculating unit 120 obtains a total zero cross frequency $N_{all_zc}$ of the analysis frame from $N_{zero_cross}$. Alternatively, a mean value $N_{mean_zc}$ of the zero cross frequencies of the sub analysis frames may be obtained. Alternatively, a variance $Vzc_{_subframe}$ of the zero cross frequencies of the sub analysis frames may be obtained. Alternatively, a zero cross frequency $V_{zc_present}$ of the present frame may be obtained. Alternatively, a mean $N_{slope_change}$ of slope change frequency of each sub analysis frame may be obtained.

Moreover, the classification criteria calculating unit 120 determines the peak of the integrated cross-correlation parameter IR(k) greater than a predetermined threshold value. In the case of an unvoiced signal, the number of peaks greater than the predetermined threshold value is small and, in the case of a voiced signal, the number of peaks greater than the predetermined threshold value is large.

The classification criteria calculating unit 120 obtains the number of peaks $N_{peak_past}$ about the peak of the integrated cross-correlation parameter IR(k) greater than a predetermined threshold value in the past frame, a number of peaks $N_{peak_analysis}$ about the peak of the integrated cross-correlation parameter IR(k) greater than a predetermined threshold value in the analysis frame, or a number of peaks $N_{peak_present}$ about the peak of the integrated cross-correlation parameter IR(k) greater than a predetermined threshold value in the present frame. Alternatively, a variance $V_{distance_peak}$ of the distances of all the peaks in the analysis frame may be obtained. Alternatively, a variance $V_{max_peak}$ of maximum peak values in each sub analysis frame may be obtained. Alternatively, a maximum integrated cross-correlation parameter value $P_{max_integrated}$ in the analysis frame may be obtained.

In addition, the classification criteria calculating unit 120 calculates a combined classification criterion by combining at least two of the classification criteria. The combined classification criterion is used for classifying transient and the voiced signals.

The classification criteria calculating unit 120 obtains the energy change rate/the minimum energy value by dividing $R_{energy}$ by $E_{min}$. Alternatively, a slope change number/minimum energy value may be obtained by dividing $N_{slope_change}$ by $E_{min}$. Alternatively, a peak number/distance variance of all peaks may be obtained by dividing $N_{peak_past}$ by $V_{distance_peak}$.

The signal level classifying unit 130 classifies the level of the input signal using the plurality of classification criteria (operation 230). When the energy classification criteria are used, the signal level of silence or noise having low energy can be determined in the input signal. When the cross-correlation parameter is used, the signal level of the non-speech, that is, the background noise, can be determined in the input signal. When the integrated cross-correlation classification criteria are used, the signal level of the unvoiced can be determined in the input signal. When the combined cross-correlation classification criterion is used, the signal level of transient noise and a voice can be determined in the input signal.

Figure 4:
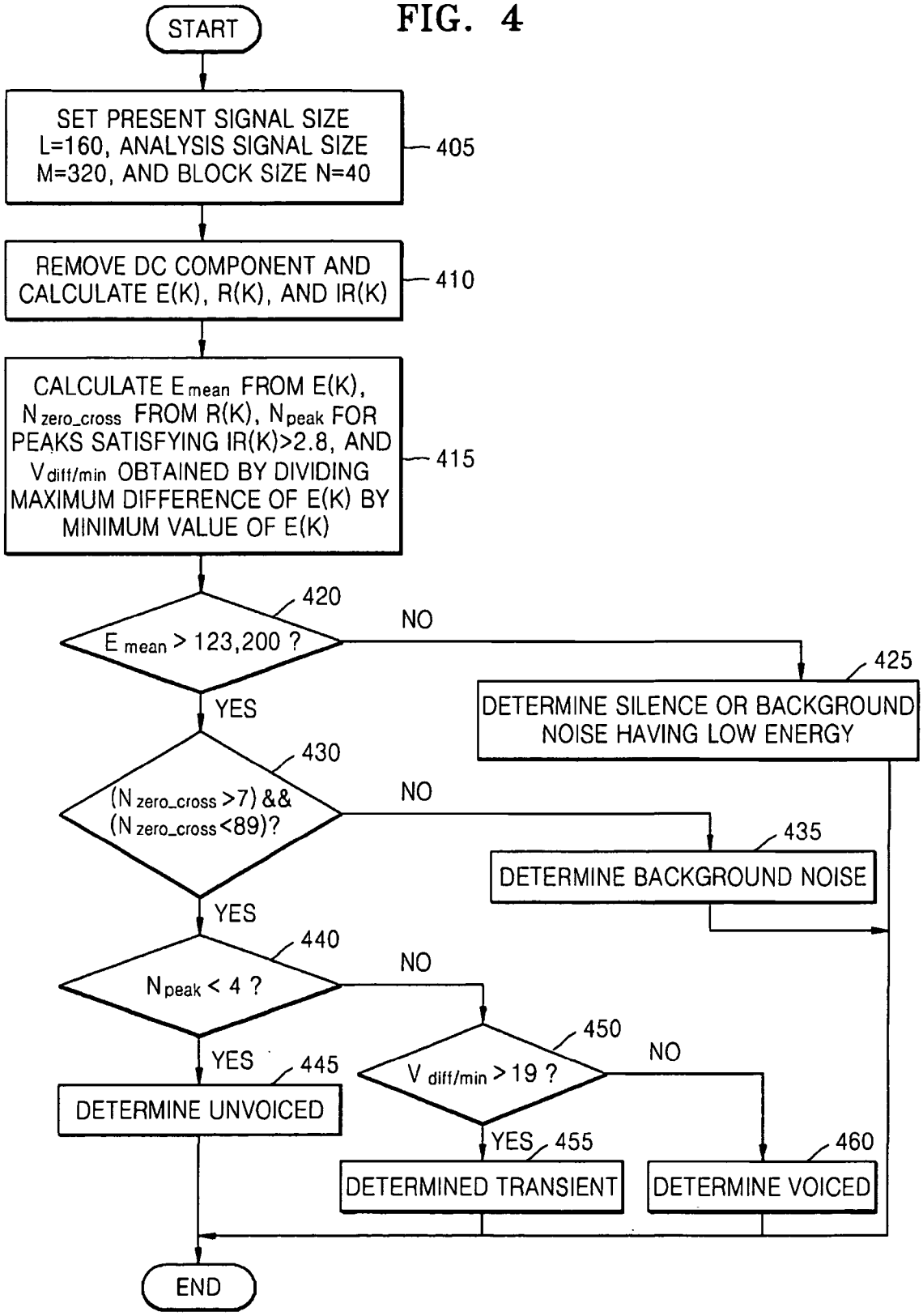
FIG. 4 is a flowchart illustrating a method of classifying a speech signal according to an exemplary embodiment of the present invention.

FIG. 4 is a flowchart illustrating a method of classifying a speech signal according to an exemplary embodiment of the present invention.

Referring to FIG. 4, the number of samples of the present signal is set to 160, the number of samples of the analysis signal is set to 320, and the number of samples of the block is set 40 (operation 405). A DC component is removed from the input signal and classification parameters (E(k), R(k), and IR(k)) are calculated (operation 410). $E_{mean}$ is calculated from the energy parameter E(k), $N_{zero_cross}$ is calculated from the cross-correlation parameter R(k), $N_{peak}$ for peaks satisfying IR(k)>2.8 is calculated from the integrated cross-correlation parameter IR(k), and a value $V_{diff/min}$ obtained by dividing a maximum difference of the energy parameter of the analysis frame by a minimum value of the energy parameter is calculated (operation 415). It is determined whether $E_{mean}>123{,}200$ (operation 420) to determine whether the speech signal exists. If $E_{mean}\leqq 123{,}200$, it is determined that the input signal is silence or background noise having low energy (operation 425). If $E_{mean}>123{,}200$, it is determined whether $N_{zero_cross}>7$ and $N_{zero_cross}\leqq 89$ (operation 430) to determine whether the input signal is a speech signal or a non-speech signal. If $N_{zero_cross}\leqq 7$ and $N_{zero_cross}\geqq 89$, it is determined that the input signal is background noise (operation 435). If $N_{zero_cross}>7$ and $N_{zero_cross}<89$, it is determined whether $N_{peak}<4$ (operation 440). If $N_{peak}<4$, it is determined that the input signal is unvoiced (operation 445). If $N_{peak}\geqq 4$, it is determined whether $V_{diff/min}>19$ (operation 450). If $V_{diff/min}>19$, it is determined that the input signal is transient (operation 455). If $V_{diff/min}\leqq 19$, it is determined that the input signal is voiced (operation 460).

Figure 5:
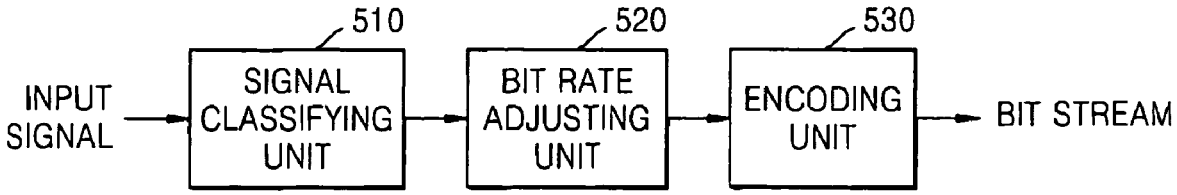
FIG. 5 is a block diagram of an apparatus for encoding a speech signal according to an exemplary embodiment of the present invention.

FIG. 5 is a block diagram of an apparatus for encoding a speech signal according to an exemplary embodiment of the present invention. Referring to FIG. 5, the apparatus according to the present exemplary embodiment includes a signal classifying unit 510, a bit rate adjusting unit 520, and an encoding unit 530. The operation of the apparatus for encoding the speech signal according to the present exemplary embodiment will be described together with a flowchart illustrating a method of encoding a speech signal illustrated in FIG. 6.

Figure 6:
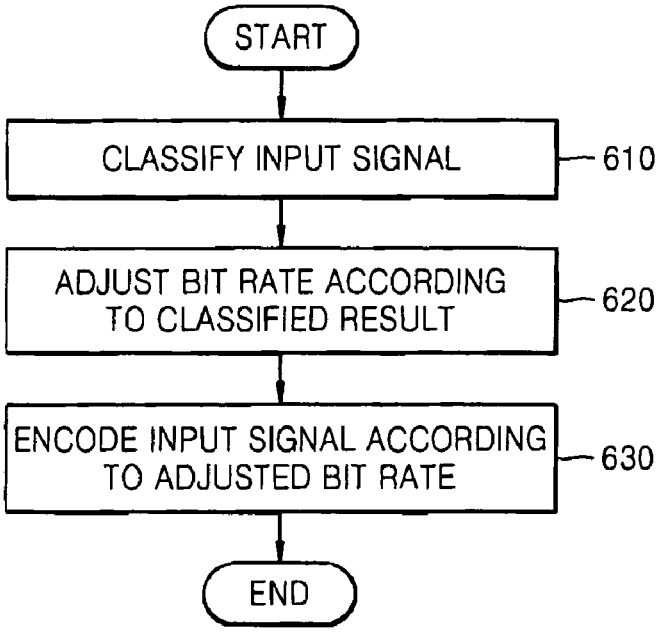
FIG. 6 is a flowchart illustrating a method of encoding a speech signal according to an exemplary embodiment of the present invention.

Referring to FIGS. 5 and 6, the signal classifying unit 510 calculates classification parameters from an input signal having block units, calculates a plurality of classification criteria from the classification parameters, and classifies the input signal using the plurality of classification criteria (operation 610). The operation of classifying the input signal is described in detail with reference to FIGS. 2 and 3.

The bit rate adjusting unit 520 adjusts the bit rate of the signal classified by the signal classifying unit 510. For example, the bit rate of non-stationary voice is set to 8 kbps, the bit rate of stationary voiced is set to 4 kbps, the bit rate of unvoiced is set to 2 kbps, and the bit rate of silence or background noise is set to 1 kbps. Such a method of adjusting the bit rate is widely known.

Furthermore, the bit rate adjusting unit 520 adjusts the bit rate in consideration of variations in the input signal. The variations in the input signal may be determined from transitions in the input signal or phonetic statistical information. For example, if it is determined that the bit rates are 8 kbps, 8 kbps, 8 kbps, 4 kbps, 8 kbps, 8 kbps, . . . by the signal classifying result, the bit rate of 4 kbps is determined to be an error due to malfunction. In this case, the bit rate adjusting unit 520 adjusts the bit rate of 4 kbps to 8 kbps.

The speech encoding unit 530 encodes the input speech signal at the bit rate determined by the bit rate adjusting unit 520 (operation 630).

In addition to the above-described exemplary embodiments, exemplary embodiments of the present invention can also be implemented by executing computer readable code/instructions in/on a medium, e.g., a computer readable medium. The medium can correspond to any medium/media permitting the storing and/or transmission of the computer readable code.

The computer readable code/instructions can be recorded/transferred in/on a medium in a variety of ways, with examples of the medium including magnetic storage media (e.g., floppy disks, hard disks, magnetic tapes, etc.), optical recording media (e.g., CD-ROMs, or DVDs), magneto-optical media (e.g., floptical disks), hardware storage devices (e.g., read only memory media, random access memory media, flash memories, etc.) and storage/transmission media such as carrier waves transmitting signals, which may include instructions, data structures, etc. Examples of storage/transmission media may include wired and/or wireless transmission (such as transmission through the Internet). Examples of wired storage/transmission media may include optical wires and metallic wires. The medium/media may also be a distributed network, so that the computer readable code/instructions is stored/transferred and executed in a distributed fashion. The computer readable code/instructions may be executed by one or more processors.

According to the present invention, if an input signal is classified in a time domain using classification parameters calculated from the input signal, the quantity of calculations is about 1.6 WMOPS (weighted million operations per second) and thus complexity is low. In addition, since a signal is divided into blocks, it is possible to reliably classify the speech signal even if rapidly changing noise is generated. Furthermore, since the apparatus for classifying the speech signal is independent of an encoder, the apparatus for classifying the speech signal according to the present invention can be compatibly used in various encoders.

Moreover, since the input signal is classified in the time domain, the apparatus for classifying the speech signal does not need high memory capacity and can be used for a wide bandwidth or a narrow bandwidth.

Although a few exemplary embodiments of the present invention have been shown and described, it would be appreciated by those skilled in the art that changes may be made in these exemplary embodiments without departing from the principles and spirit of the invention, the scope of which is defined in the claims and their equivalents.

What is claimed is:

1. A method of classifying a speech signal comprising:

calculating from an input signal in block units classification parameters including an energy parameter of the input signal, a cross-correlation parameter between a specific block of a present frame and the input signal, and an integrated cross-correlation parameter obtained by accumulating the cross-correlation parameter until a sign of a slope of the integrated cross-correlation parameter changes;

calculating a plurality of classification criteria from the classification parameters; and classifying a level of the input signal using the plurality of classification criteria, wherein the method is performed using at least one processor.

2. The method of claim 1, wherein the specific block is a block having the highest energy in the present frame.

3. The method of claim 1, wherein the specific block is a block having energy closest to mean energy of the present frame in the present frame.

4. The method of claim 1, wherein the specific block is a block having energy closest to median energy between the highest energy and lowest energy of the present frame in the present frame.

5. The method of claim 1, wherein the specific block is a block located at the center of the present frame.

6. The method of claim 1, wherein the classification criteria include at least one of an energy classification criterion calculated using the mean energy of each sub analysis frame obtained from the energy parameter, a cross-correlation classification criterion calculated using a zero cross frequency of the cross-correlation parameter, and an integrated cross-correlation classification criterion calculated using peaks of the integrated cross-correlation parameter greater than a predetermined threshold value.

7. The method of claim 6, wherein the energy classification criterion includes at least one of a mean energy of the present frame, a minimum energy value between a first sub analysis frame and a final sub analysis frame, and an energy change rate obtained by dividing a maximum energy value between the first sub analysis frame and the final sub analysis frame by the minimum energy value.

8. The method of claim 6, wherein the cross-correlation classification criterion includes at least one of a total zero cross frequency of an analysis frame, a mean of the zero cross frequency of each sub analysis frame, a variance of the zero cross frequency of each sub analysis frame, a zero cross frequency of the present frame, and a mean of slope change frequency of each sub analysis frame.

9. The method of claim 6, wherein the integrated cross-correlation classification criterion includes at least one of the number of peaks of a past frame, the number of peaks of an analysis frame, the number of peaks of the present frame, a variance of distance of all peaks in the analysis frame, a variance of maximum peaks in each the sub analysis frame, and a maximum integrated cross-correlation parameter in the analysis frame.

10. The method of claim 6, wherein the classification criteria further include a combined classification criterion obtained by combining at least two of the classification criteria.

11. The method of claim 10, wherein the combined classification criterion includes at least one of the energy change rate/the minimum energy value obtained by dividing the energy change rate by the minimum energy value, the mean of the slope change frequency/the minimum energy value obtained by dividing the mean of slope change frequency of each sub analysis frame by the minimum energy value, and the number of peaks/the variance of distance obtained by dividing the number of peaks of the past frame by the variance of distance of all peaks in the analysis frame.

12. An apparatus for classifying a speech signal comprising:

a parameter calculating unit which calculates classification parameters from an input signal in block units, the classification parameters including an energy parameter of the input signal, a cross-correlation parameter between a specific block of a present frame and the input signal, and an integrated cross-correlation parameter obtained by accumulating the cross-correlation parameter until a sign of a slope of the integrated cross-correlation parameter changes;

a classification criteria calculating unit which calculates a plurality of classification criteria from the classification parameters; and a signal level classifying unit which classifies a level of the input signal using the plurality of classification criteria.

13. The apparatus of claim 12, wherein the specific block is a block having the highest energy in the present frame.

14. The apparatus of claim 12, wherein the specific block is a block having energy closest to mean energy of the present frame in the present frame.

15. The apparatus of claim 12, wherein the specific block is a block having energy closest to median energy between the highest energy and lowest energy of the present frame in the present frame.

16. The apparatus of claim 12, wherein the specific block is a block located at the center of the present frame.

17. The apparatus of claim 12, wherein the classification criteria include at least one of an energy classification criterion calculated using the mean energy of each sub analysis frame obtained from the energy parameter, a cross-correlation classification criterion calculated using a zero cross frequency of the cross-correlation parameter, and an integrated cross-correlation classification criterion calculated using peaks of the integrated cross-correlation parameter greater than a predetermined threshold value.

18. The apparatus of claim 17, wherein the energy classification criterion includes at least one of a mean energy of the present frame, a minimum energy value between a first sub analysis frame and a final sub analysis frame, and an energy change rate obtained by dividing a maximum energy value between the first sub analysis frame and the final sub analysis frame by the minimum energy value.

19. The apparatus of claim 17, wherein the cross-correlation classification criterion includes at least one of a total zero cross frequency of an analysis frame, a mean of the zero cross frequency of each sub analysis frame, a variance of the zero cross frequency of each sub analysis frame, a zero cross frequency of the present frame, and a mean of slope change frequency of each sub analysis frame.

20. The apparatus of claim 17, wherein the integrated cross-correlation classification criterion includes at least one of the number of peaks of a past frame, the number of peaks of an analysis frame, the number of peaks of the present frame, a variance of distance of all peaks in the analysis frame, a variance of maximum peaks of the sub analysis frame, and a maximum integrated cross-correlation parameter in the analysis frame.

21. The apparatus of claim 17, wherein the classification criteria further include a combined classification criterion obtained by combining at least two of the classification criteria.

22. The apparatus of claim 21, wherein the combined classification criterion includes at least one of the energy change rate/the minimum energy value obtained by dividing the energy change rate by the minimum energy value, the mean of slope change frequency/the minimum energy value obtained by dividing the mean of slope change frequency of each sub analysis frame by the minimum energy value, and the number of peaks/the variance of distance obtained by dividing the number of peaks of the past frame by the variance of distance of all peaks in the analysis frame.

23. A method for encoding a speech signal comprising:

calculating classification parameters from an input signal in block units, calculating a plurality of classification criteria from the classification parameters, and classifying the input signal using the plurality of classification criteria, the classification parameters including an energy parameter of the input signal, a cross-correlation parameter between a specific block of a present frame and the input signal, and an integrated cross-correlation parameter obtained by accumulating the cross-correlation parameter until a sign of a slope of the integrated cross-correlation parameter changes;

adjusting a bit rate of the present frame according to a result of classifying the input signal; and encoding the input signal according to the adjusted bit rate and outputting a bit stream, wherein the method is performed using at least one processor.

24. The method of claim 23, wherein the adjusting of the bit rate comprises adjusting the bit rate of the present frame in consideration of variations in the input signal.

25. An apparatus for encoding a speech signal comprising:

a signal classifying unit which calculates classification parameters from an input signal in block units, calculates a plurality of classification criteria from the classification parameters, and classifies the input signal using the plurality of classification criteria, the classification parameters including an energy parameter of the input signal, a cross-correlation parameter between a specific block of a present frame and the input signal, and an integrated cross-correlation parameter obtained by accumulating the cross-correlation parameter until a sign of a slope of the integrated cross-correlation parameter changes;

a bit rate adjusting unit which adjusts a bit rate of the present frame according to a result of classifying the input signal; and an encoding unit which encodes the input signal according to the adjusted bit rate and outputting a bit stream.

26. The apparatus of claim 25, wherein the bit rate adjusting unit adjusts the bit rate of the present frame in consideration of variations in the input signal.

27. A non-transitory computer-readable medium having embodied thereon a computer program for executing a method comprising:

calculating classification parameters from an input signal in block units, the classification parameters including an energy parameter of the input signal, a cross-correlation parameter between a specific block of a present frame and the input signal, and an integrated cross-correlation parameter obtained by accumulating the cross-correlation parameter until a sign of a slope of the integrated cross-correlation parameter changes;

calculating a plurality of classification criteria from the classification parameters; and classifying a level of the input signal using the plurality of classification criteria.

28. A non-transitory computer-readable medium having embodied thereon a computer program for executing a method comprising:

calculating a classification parameter from an input signal in block units, calculating a plurality of classification criteria from the classification parameters, and classifying the input signal using the plurality of classification criteria, the classification parameter including an energy parameter of the input signal, a cross-correlation parameter between a specific block of a present frame and the input signal, and an integrated cross-correlation parameter obtained by accumulating the cross-correlation parameter until a sign of a slope of the integrated cross-correlation parameter changes;

adjusting a bit rate of the present frame according to results of classifying the input signal; and encoding the input signal according to the adjusted bit rate and outputting a bit stream.

* * * * *

UNITED STATES PATENT AND TRADEMARK OFFICE

CERTIFICATE OF CORRECTION

PATENT NO. : 8,175,869 B2
APPLICATION NO. : 11/480449
DATED : May 8, 2012
INVENTOR(S) : Hosang Sung et al.

It is certified that error appears in the above-identified patent and that said Letters Patent is hereby corrected as shown below:

Column 9, Line 20, In Claim 9, delete "each the" and insert -- each of the --, therefor.

Signed and Sealed this
Thirty-first Day of July, 2012

David J. Kappos

David J. Kappos
*Director of the United States Patent and Trademark Office*